US006738086B2

(12) United States Patent
Oka

(10) Patent No.: US 6,738,086 B2
(45) Date of Patent: May 18, 2004

(54) IMAGE RECORDING APPARATUS

(75) Inventor: Junichi Oka, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 10/166,633

(22) Filed: Jun. 12, 2002

(65) Prior Publication Data

US 2002/0191069 A1 Dec. 19, 2002

(30) Foreign Application Priority Data

Jun. 13, 2001 (JP) ..... 2001-177990

(51) Int. Cl.[7] ..... B41J 27/00
(52) U.S. Cl. ..... 347/241; 347/258
(58) Field of Search ..... 347/242, 244, 347/256, 258, 238, 241, 257

(56) References Cited

U.S. PATENT DOCUMENTS 5,258,777 A * 11/1993 DeJager et al. ..... 347/258
6,330,019 B1 * 12/2001 Kubokawa ..... 347/241
6,377,739 B1 4/2002 Richardson et al. ..... 385/115
2002/0101501 A1 * 8/2002 Miyagawa ..... 347/238

FOREIGN PATENT DOCUMENTS

| | | |
|---|---|---|
| EP | 0945276 A1 | 9/1999 |
| JP | 7-214803 | 8/1995 |
| JP | 2000-141749 | 5/2000 |
| WO | WO 91/08905 | 6/1991 |
| WO | WO 92/16374 | 10/1992 |

* cited by examiner

*Primary Examiner*—Hai Pham
(74) *Attorney, Agent, or Firm*—McDermott, Will & Emery

(57) ABSTRACT

Optical fibers constituting optical fiber rows are positioned as pinched between base plates defining numerous positioning V-grooves. In each optical fiber row, the optical fibers are arranged at a fixed pitch P. The optical fibers have projections thereof arranged at a fixed pitch PX in a secondary scanning direction, and at a fixed pitch PY in a primary scanning direction. The positions of the projections of the optical fibers constituting the optical fiber rows are partly coinciding in the secondary scanning direction.

16 Claims, 7 Drawing Sheets

IMAGE RECORDING APPARATUS

BACKGROUND OF THE INVENTION

1. Field of the Invention

The present invention relates to an image recording apparatus for recording images by irradiating a recording material with light beams.

2. Description of the Related Art

In such an image recording apparatus, a recording material is irradiated with light beams emitted from a plurality of optical fibers connected to light sources such as semiconductor lasers, and transmitted through an optical system such as an imaging optical system. At the same time, the optical system and the recording material are moved relative to each other in a primary scanning direction and a secondary scanning direction. In this way, a primary scan and a secondary scan are performed to record an image.

Such an image recording apparatus uses a plurality of optical fibers arranged in rows forming an array. With these rows of optical fibers, luminous points may be arranged at intervals each substantially corresponding to an outside diameter of each optical fiber (i.e. outside diameter of a clad of each optical fiber).

However, the optical fiber has a core diameter defining a light transmitting portion, which is smaller than the clad diameter. Even in a multimode fiber, the core diameter is at most a half of the clad diameter. Consequently, the clad portion of each optical fiber forms a gap on a recording surface to lower the image recording density.

To solve this problem, the formation of gaps between scan lines is prevented by tilting the rows of optical fibers by an appropriate angle relative to the primary scanning direction. In this construction, however, an optical image enlarges with an increase in the number of optical fibers. This results in a disadvantage of having to enlarge optics such as lenses.

An image recording apparatus is proposed in Japanese Patent Publication (Unexamined) No. 2000-141749 to overcome such a disadvantage. This apparatus has N rows of optical fibers supported at a fixed pitch P on a base plate, the optical fiber rows being arranged parallel to a secondary scanning direction. These optical fiber rows are shifted in the secondary scanning direction by 1/N of the pitch P of the optical fibers.

The image recording apparatus described in Publication No. 2000-141749 is fine insofar as enabling a high density image recording without enlarging optics. However, since the optical fibers are arranged at the relatively small pitch P, positioning is far from easy when arranging a plurality of optical fiber rows as shifted by 1/N of the pitch P in the secondary scanning direction. This makes the above apparatus difficult to manufacture.

SUMMARY OF THE INVENTION

The object of the present invention, therefore, is to provide an image recording apparatus, easy to manufacture, for enabling a high density image recording without enlarging optics.

The above object is fulfilled, according to the present invention, by an image recording apparatus for recording an image on a recording material by irradiating the recording material with light beams emitted from a plurality of optical fibers, and causing the light beams to make a primary scan and a secondary scan of the recording material, the apparatus comprising a plurality of optical fiber rows each having a plurality of optical fibers supported by a base plate having a plurality of grooves arranged at a fixed pitch P and arranged at said fixed pitch P, the plurality of optical fiber rows being arranged parallel to each other in a direction intersecting a primary scanning direction and a secondary scanning direction, optical fibers disposed at adjacent ends of the plurality of optical fiber rows being shifted from each other by a multiple of the fixed pitch P in a direction of arrangement of the optical fibers, and the optical fibers constituting the plurality of optical fiber rows having projections thereof arranged at a fixed pitch PY in the primary scanning direction.

This image recording apparatus is capable of a high density image recording without enlarging optics. There is no need to arrange the plurality of optical fiber rows as shifted by 1/N of the pitch P in the secondary scanning direction. Thus, the apparatus according to the invention is easy to manufacture.

In a preferred embodiment, the plurality of optical fiber rows are in form of a pair of optical fiber rows arranged at an adjustable angle to the secondary scanning direction. This construction facilitates a positional adjustment between the optical fiber rows.

Preferably, the optical fibers constituting the plurality of optical fiber rows have projections thereof in the secondary scanning direction arranged at a pitch PX of projections in the secondary scanning direction of the optical fibers constituting each of the optical fiber rows. This facilitates control of image recording timing.

The plurality of optical fiber rows may include an equal number of optical fibers, optical fibers disposed at ends of the plurality of optical fiber rows coinciding with each other in the primary scanning direction. This further facilitates control of image recording timing.

In another aspect of the invention, an image recording apparatus is provided for recording an image on a recording material by irradiating the recording material with light beams emitted from a plurality of optical fibers, and causing the light beams to make a primary scan and a secondary scan of the recording material, the apparatus comprising a pair of optical fiber rows each having a plurality of optical fibers supported by a base plate having a plurality of grooves arranged at a fixed pitch P and arranged at said fixed pitch P, the pair of optical fiber rows being arranged parallel to each other in a direction intersecting a primary scanning direction and a secondary scanning direction, the pair of optical fiber rows including an equal number of optical fibers, the pair of optical fiber rows being arranged at an adjustable angle to the secondary scanning direction, optical fibers disposed at adjacent ends of the pair of optical fiber rows being shifted from each other by a multiple of the fixed pitch P in a direction of arrangement of the optical fibers;, and the optical fibers constituting the pair of optical fiber rows having projections thereof arranged at a fixed pitch PY in the primary scanning direction.

In a further aspect of the invention, an image recording apparatus is provided for recording an image on a recording material by irradiating the recording material with light beams emitted from a plurality of optical fibers, and causing the light beams to make a primary scan and a secondary scan of the recording material, the apparatus comprising a pair of optical fiber rows each having a plurality of optical fibers supported by a base plate having a plurality of grooves arranged at a fixed pitch P and arranged at said fixed pitch P, the pair of optical fiber rows being arranged parallel to each other in a direction intersecting a primary scanning direction and a secondary scanning direction, the pair of optical fiber rows being arranged parallel to each other in a direction intersecting a primary scanning direction and a secondary scanning direction, the pair of optical fiber rows including an equal number of optical fibers, the pair of optical fiber rows being arranged at an adjustable angle to the secondary scanning direction, optical fibers disposed at ends of the pair of optical fiber rows coinciding with each other in the primary scanning direction, and the optical fibers constituting the pair of optical fiber rows having projections thereof arranged at a fixed pitch PY in the primary scanning direction.

Other features and advantages of the present invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
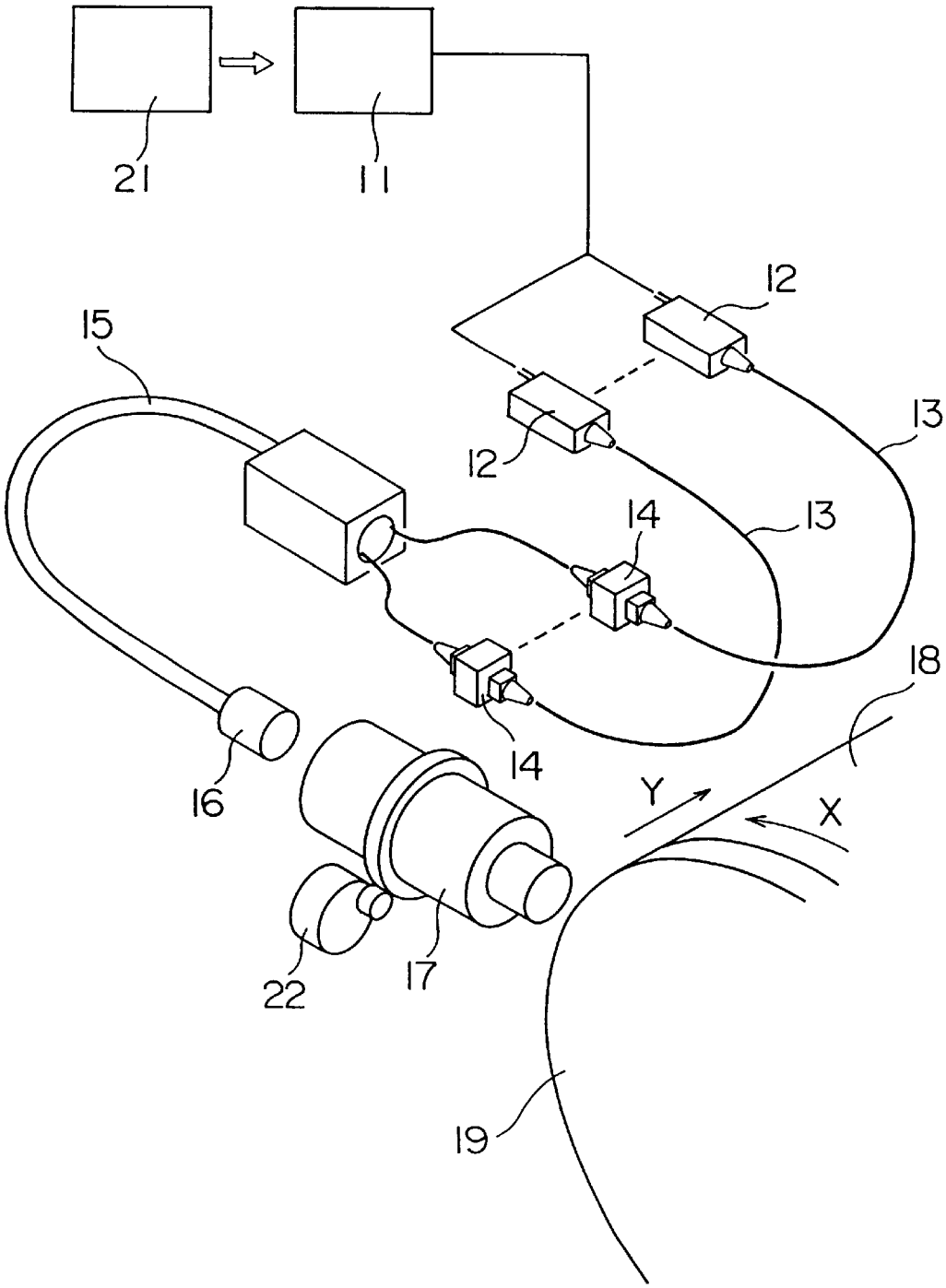
FIG. 1 is a perspective view showing a principal portion of an image recording apparatus according to the invention.

An embodiment of the present invention will be described hereinafter with reference to the drawings. FIG. 1 is a perspective view showing a principal portion of an image recording apparatus according to the invention.

This image recording apparatus includes numerous semiconductor lasers 12 driven by a controller 11, an optical fiber array 15 having an entrance end thereof connected through fiber connector adaptors 14 to optical fibers 13 connected to the semiconductor lasers 12, an imaging optical system 17 opposed to an exit end 16 of the optical fiber array 15, and a recording drum 19 with a recording material 18 mounted peripherally thereof.

In this image recording apparatus, each semiconductor laser 12 is driven by the controller 11 in response to image data 21. Modulated light beams emitted from the respective semiconductor lasers 12 are transmitted through the optical fibers 13, fiber connector adaptors 14 and optical fiber array 15. The light beams emerging from the exit end 16 of the optical fiber array 15 enter the imaging optical system 17, and then are imaged on the recording material 18 by the action of the imaging optical system 17. A spot diameter and the like of each light beam on the recording material 18 are variable to desired values as the magnification of the imaging optical system 17 is varied by a stepping motor 22.

The image recording apparatus records an image on the recording material 18 by rotating the recording drum 19 while each semiconductor laser 12 is driven in response to image data 21. The drum rotation moves the recording material 18 in an X-direction (i.e. primary scanning direction) shown in FIG. 1. At the same time, the imaging optical system 17 is moved in a Y-direction (i.e. secondary scanning direction).

This embodiment uses a thermosensitive material as the recording material 18, which is responsive to heat generated by light beams to record images.

Figure 2:
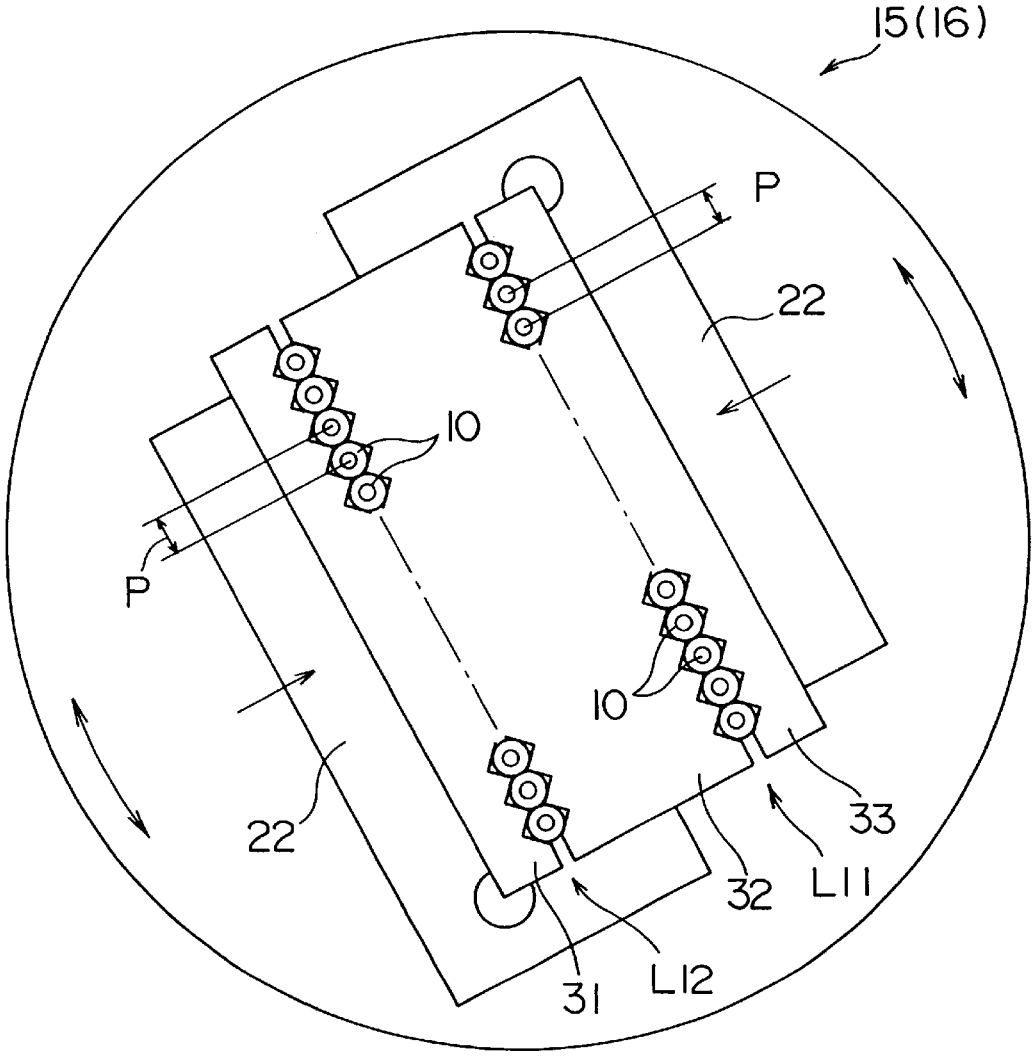
FIG. 2 is a front view of an exit end of an optical fiber array.

FIG. 2 is a front view of the exit end 16 of the above optical fiber array 15.

This optical fiber array 15 includes a pair of optical fiber rows L11 and L12 each having a plurality of optical fibers 10 juxtaposed at a fixed pitch P along a straight line. The optical fibers 10 constituting these optical fiber rows L11 and L12 are positioned as pinched between a base plate 32 with numerous V-grooves formed in opposite sides thereof for positioning the optical fibers 10, and a pair of base plates 31 and 33 each with numerous V-grooves formed in one side thereof for positioning the optical fibers 10. The pair of base plates 31 and 33 are fixed by a pair of presser plates 22. These base plates 31, 32 and 33 are rotatable with the pair of optical fiber rows L11 and L12 about an axis perpendicular to the exit end of the optical fiber array 15 (i.e. an axis perpendicular to the plane of FIG. 2).

Figure 3:
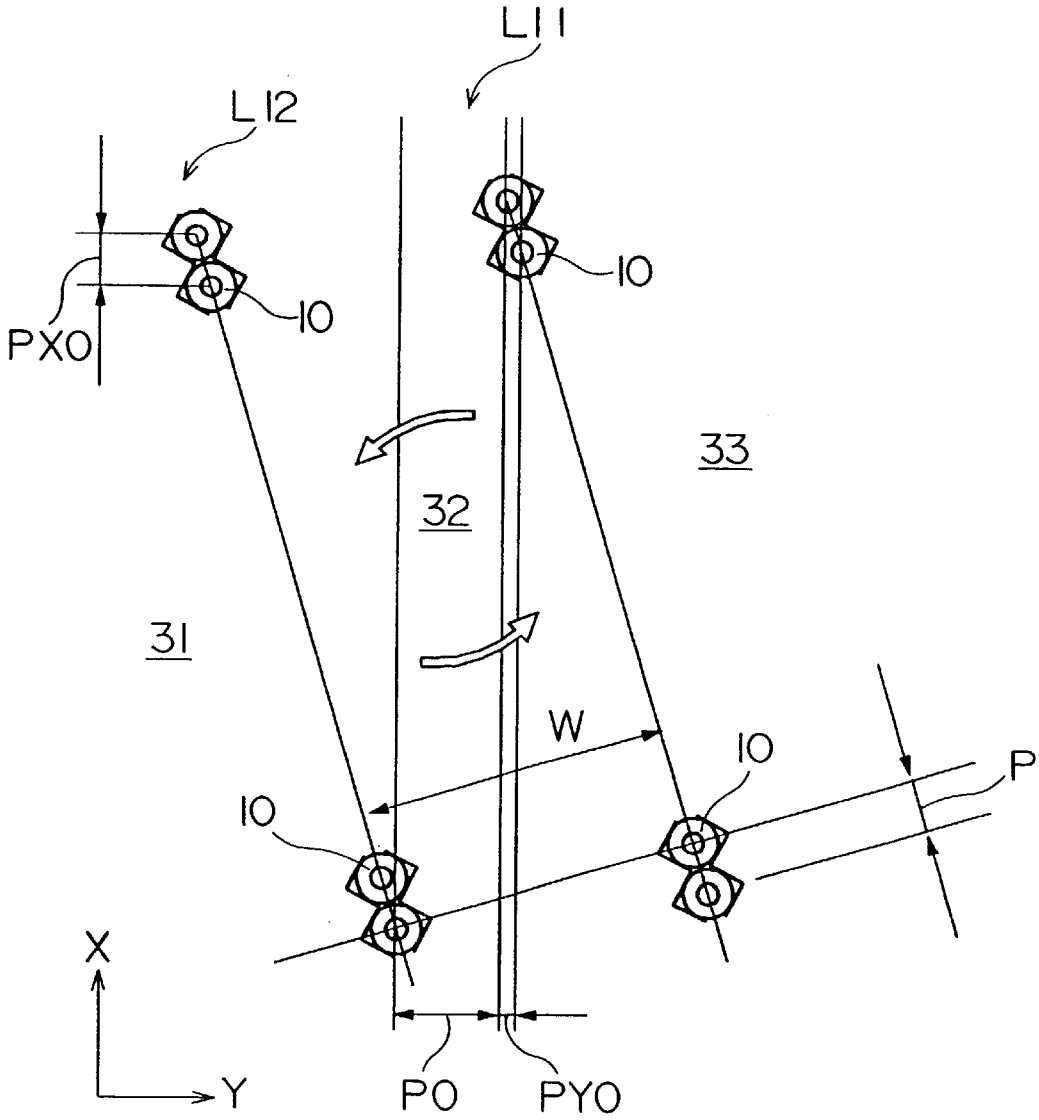
FIG. 3 is an explanatory view showing an arrangement of optical fibers in a first embodiment of the invention.
Figure 4:
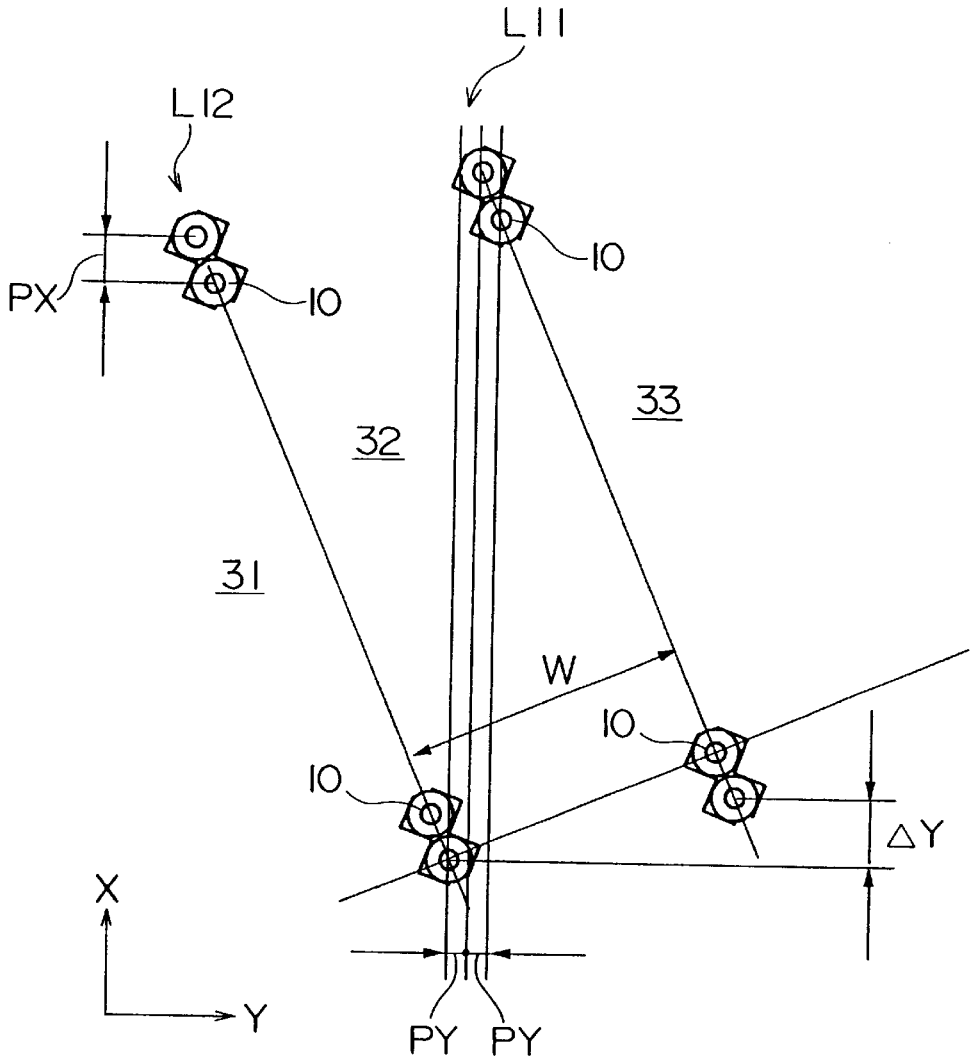
FIG. 4 is an explanatory view showing the arrangement of optical fibers in the first embodiment.

An arrangement of the optical fibers 10 in the optical fiber array 15 will be described next. FIGS. 3 and 4 are explanatory views showing an arrangement of optical fibers 10 in a first embodiment of the invention.

Referring to FIG. 3, as noted above, each of the optical fiber rows L11 and L12 has optical fibers 10 arranged at a fixed pitch P. The optical fiber disposed at an end of each optical fiber row L11 or L12 is shifted by the pitch P in the direction of arrangement of the optical fibers 10.

As shown in this figure, the optical fiber rows L11 and L12 are arranged parallel to each other in a direction intersecting the X-direction (primary scanning direction) and Y-direction (secondary scanning direction). Consequently, the projections in the secondary scanning direction (i.e. arrangement in the primary scanning direction) of the optical fibers 10 in the optical fiber rows L11 and L12 are at a fixed pitch PX0. The projections in the primary scanning direction (i.e. arrangement in the secondary scanning direction) of the optical fibers 10 in the optical fiber rows L11 and L12 are at a fixed pitch PY0. However, a spacing P0 between the projections in the primary scanning direction (i.e. spacing in the secondary scanning direction) of the optical fiber rows L11 and L12 disagrees with the above pitch PY0.

In such a case, as indicated by arrows in FIGS. 2 and 3, the base plates 31, 32 and 33 are rotated with the pair of optical fiber rows L11 and L12 about the axis perpendicular to the exit end of the optical fiber array 15 (i.e. the axes perpendicular to the planes of FIGS. 2 and 3), to equalize the pitch of the projections in the primary scanning direction (arrangement in the secondary scanning direction) of the optical fibers 10, and the spacing between the projections in the primary scanning direction (spacing in the secondary scanning direction) of the optical fiber rows L11 and L12.

FIG. 4 is an explanatory view showing the arrangement of optical fibers 10 in such a state.

In this state, the projections in the primary scanning direction (arrangement in the secondary scanning direction) of the optical fibers 10 constituting the pair of optical fiber rows L11 and L12, including the spacing between the projections in the primary scanning direction of the optical fiber rows L11 and L12, are all arranged at a pitch PY. Consequently, light beams are emitted at the pitch PY from the exit end 16 of the optical fiber array 15. By varying the magnification of the imaging optical system 17 disposed at the downstream stage to adjust the pitch PY, the pitch of light beams irradiating the recording material 18 may be brought into agreement with a pitch corresponding to a resolution required for image recording.

In this state, the projections in the secondary scanning direction (arrangement in the primary scanning direction) of the optical fibers 10 in the optical fiber rows L11 and L12 are arranged at a pitch PX. The optical fibers 10 disposed at the ends of the optical fiber rows L11 and L12 are shifted from each other by a distance ΔY in the X-direction (primary scanning direction). It is therefore necessary to adjust light beam emission timing for recording an image.

Figure 5:
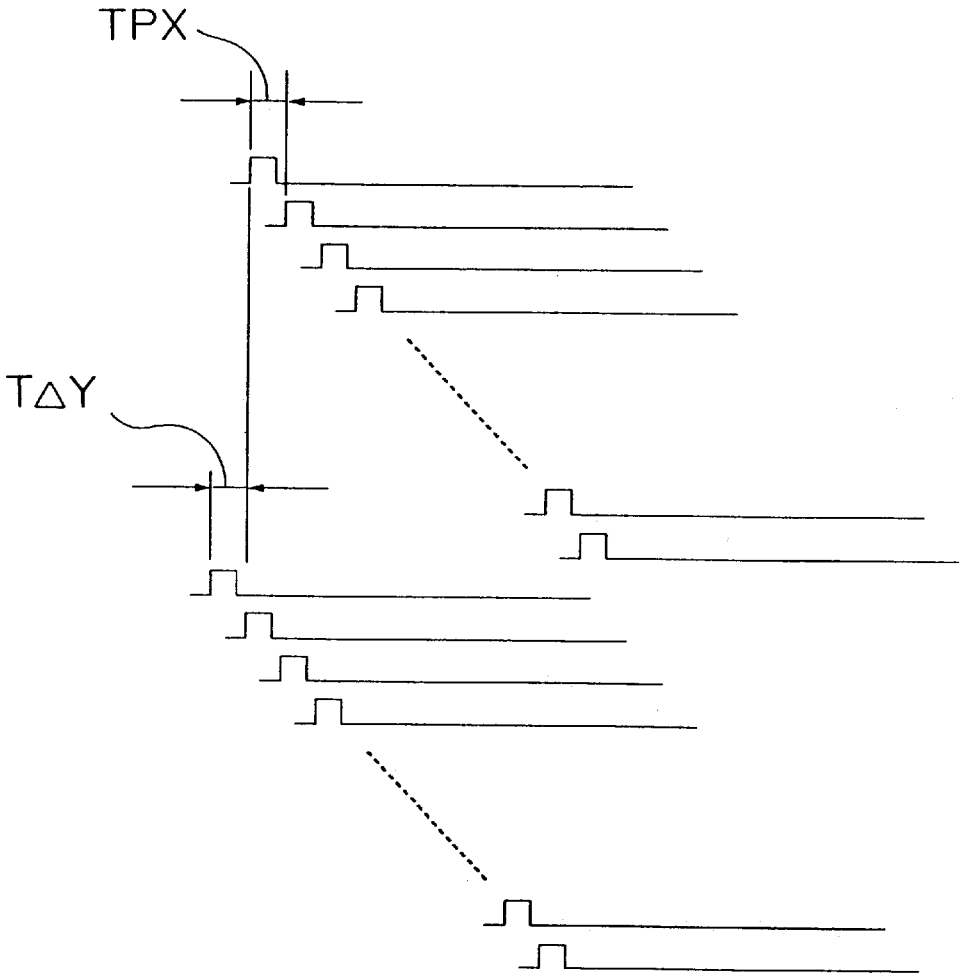
FIG. 5 is an explanatory view showing emission timing of light beams.

FIG. 5 is an explanatory view showing emission timing of the light beams. This figure shows, along a time base, signals applied to the respective semiconductor lasers 12.

The emission timing of the light beams from the optical fibers 10 is determined by the pitch PX of the projections in the secondary scanning direction (arrangement of primary scanning direction) of the optical fibers 10, the distance ΔY in the X-direction (primary scanning direction) of the optical fibers disposed at the ends of the optical fiber rows, and the magnification of the imaging optical system 17.

Reference TPX in this figure denotes a delay time in the emission timing due to the pitch PX in the primary scanning direction of the optical fibers 10 constituting the optical fiber rows L11 and L12. Reference TΔY denotes a delay time in the emission timing due to the distance ΔY in the X-direction (primary scanning direction) between the optical fibers 10 disposed at the ends of the optical fiber rows L11 and L12. The emission timing of the light beams is adjusted by adjusting timing of driving the semiconductor lasers 12 by the controller 11.

In the image recording apparatus having the above construction, there is no need to arrange the plurality of optical fiber rows as shifted by 1/N of the pitch P in the secondary scanning direction as required in the image recording apparatus described in Japanese Patent Publication (Unexamined) No. 2000-141749. Thus, the apparatus according to the present invention is easy to manufacture.

This image recording apparatus may reduce the delay time TPX in the emission timing due to the pitch PX in the primary scanning direction of the optical fibers 10 constituting the optical fiber rows L11 and L12, excluding a portion extending from the optical fiber row L11 to the optical fiber row L12. Thus, immediately after the recording material 18 is irradiated with a light beam emitted from a certain optical fiber 10, the recording material 18 is irradiated with a light beam emitted from a next optical fiber 10. Before heat by the irradiation of a light beam diffuses on the recording material 18, a next light beam is emitted. This produces an effect of improving the apparent sensitivity of the recording material 18 in the form of a thermosensitive material.

Figure 6:
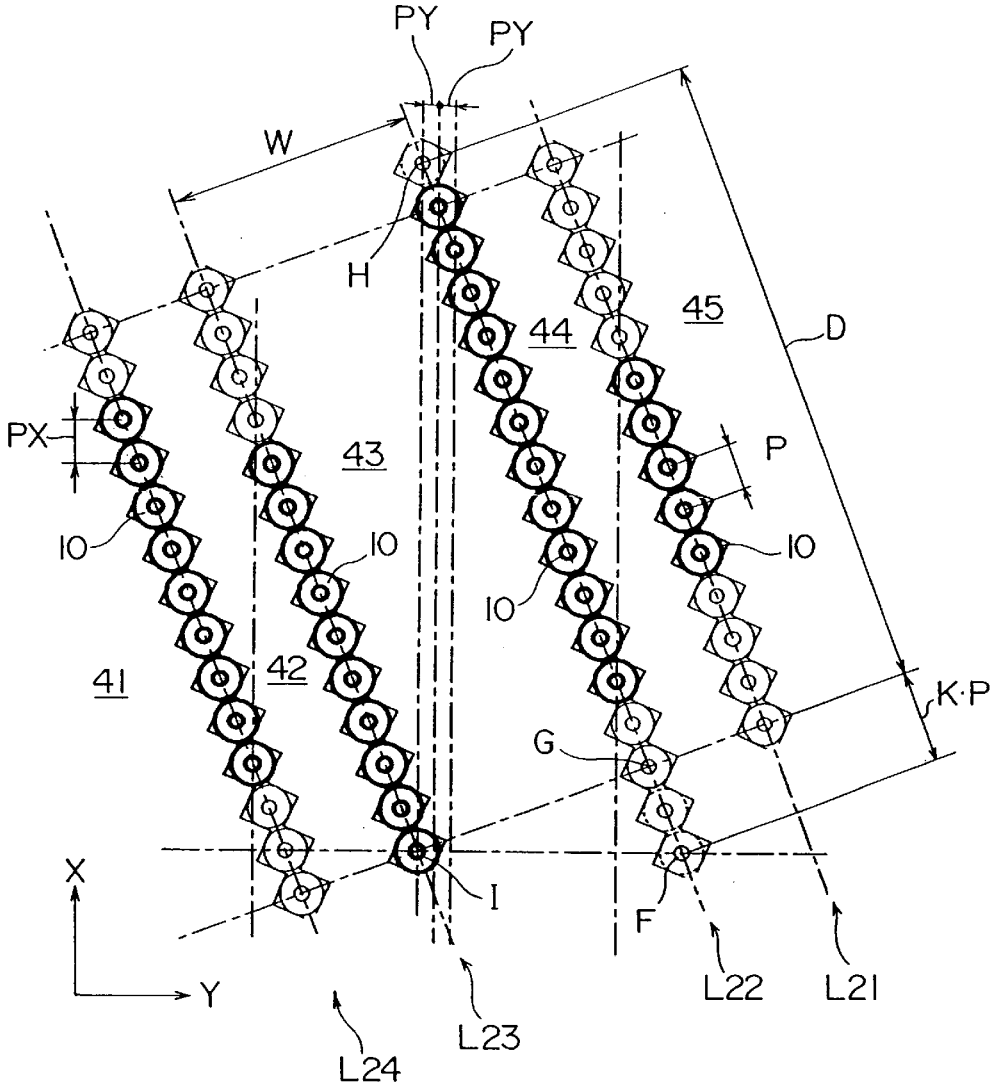
FIG. 6 is an explanatory view showing an arrangement of optical fibers in a second embodiment of the invention.

An arrangement of optical fibers 10 in a second embodiment will be described next. FIG. 6 is an explanatory view showing the arrangement of optical fibers 10 in the second embodiment of the invention. In FIG. 6, real optical fibers 10 are shown in thick lines, virtual optical fibers 10 in thin lines, and virtual optical fibers 10 used for illustrating distance are shown in broken lines.

The first embodiment shown in FIGS. 2 through 4 uses the pair of optical fiber rows L11 and L12 having an equal number of optical fibers 10. The second embodiment shown in FIG. 6 uses a plurality of optical fiber rows L21, L22, L23 and L24 having different numbers of optical fibers 10.

The optical fibers 10 constituting these optical fiber rows L21, L22, L23 and L24 are positioned as pinched between three base plates 42, 43 and 44 each with numerous V-grooves formed in opposite sides thereof for positioning the optical fibers 10, and a pair of base plates 41 and 45 each with numerous V-grooves formed in one side thereof for positioning the optical fibers 10, which are similar to the base plates, 31, 32 and 33 in the first embodiment.

Where the plurality of optical fiber rows L21, L22, L23 and L24 are arranged in this way, positions of the projections in the primary scanning direction (arrangement in the secondary scanning direction) of the optical fibers 10 cannot be adjusted as in the first embodiment in which the optical fiber rows L11 and L12 are rotated. In the second embodiment, therefore, the arrangement of optical fibers 10 is determined based on equations to be described hereinafter.

The arrangement of optical fibers 10 will be described next. While the following description refers mainly to the second optical fiber row L22 and third optical fiber row L23, the same applies also to the other optical fiber rows.

In each of the optical fiber rows L21, L22, L23 and L24 in the second embodiment, the optical fibers 10 are arranged at a fixed pitch P as in the first embodiment. The optical fiber rows L21, L22, L23 and L24 are arranged parallel to one another in a direction intersecting the X-direction (primary scanning direction) and Y-direction (secondary scanning direction). As in the first embodiment, the projections in the secondary scanning direction (arrangement in the primary scanning direction) of the optical fibers 10 are at a fixed pitch PX. The projections in the primary scanning direction (arrangement in the secondary scanning direction) of the optical fibers 10 are at a fixed pitch PY. The positions of the projections in the secondary scanning direction of the optical fibers 10 constituting the optical fiber rows L21, L22, L23 and L24 partly coincide with each other.

Assume that an optical fiber virtually disposed next to the optical fiber 10 at the rear end (upper end in FIG. 6) of the optical fiber row L22 has the center H. Assume that the optical fiber 10 at the forward end (lower end in FIG. 6) of the optical fiber row L23 has the center I. A perpendicular line extending from the center I has a point of intersection G with a straight line extending through the centers of the optical fibers 10 constituting the optical fiber row L22. A straight line extending in the Y-direction (secondary scanning direction) from the center I has a point of intersection F with the straight line extending through the centers of the optical fibers 10 constituting the optical fiber row L22. The points G and H have a spacing D therebetween. The points F and G have a spacing k·p therebetween (k being an integer which is 2 in this embodiment). The optical fiber row L22 and optical fiber row L23 have a spacing W therebetween. The points G and I are located centrally of optical fibers arranged virtually in the optical fiber row L22.

In this case, a triangle IGH and a triangle FGI are similar figures, and therefore $W=[k\cdot P\cdot D]^{1/2}$. That is, W equals the route of the product of k, P and D. Where the optical fiber rows L21, L22, L23 and L24 are inclined at an angle θ to the primary scanning direction, $\theta=\tan^{-1}(W/D)$. That is, θ equals the inverse arc tangent of a value of W divided by D.

Based on the above, the base plate 43 is prepared so that the spacing W between the optical fiber row L22 and optical fiber row L23 has a value derived from the above equation. The base plate 43 is disposed as inclined by the angle θ derived from the above equation. As a result, the projections in the secondary scanning direction (arrangement in the primary scanning direction) of the optical fibers 10 are arranged at the pitch PX, with part thereof coinciding with each other, and the projections in the primary scanning direction (arrangement in the secondary scanning direction) of the optical fibers 10 are arranged at the pitch PY.

In the image recording apparatus having the above construction also, there is no need to arrange the plurality of optical fiber rows as shifted by 1/N of the pitch P in the secondary scanning direction as required in the image recording apparatus described in Japanese Patent Publication (Unexamined) No. 2000-141749. Thus, the apparatus in this embodiment is easy to manufacture.

The image recording apparatus in this embodiment also may reduce the delay time TPX in the emission timing due to the pitch PX in the primary scanning direction of the optical fibers 10 constituting the optical fiber rows L21, L22, L23 and L24, excluding portions extending between the optical fiber rows L21, L22, L23 and L24. This produces an effect of improving the apparent sensitivity of the recording material 18 in the form of a thermosensitive material.

Further, in the image recording apparatus in this embodiment, the positions of the projections in the secondary scanning direction of the optical fibers 10 constituting the optical fiber rows L21, L22, L23 and L24 partly coincide with one another. Since the phases of image recording timing of the optical fibers 10 are in agreement, the image recording timing, i.e. driving of the semiconductor lasers 12, may easily be controlled by the controller 11.

To illustrate a general concept of the construction according to the invention, the optical fiber rows L21, L22, L23, and L24 in this embodiment have been described as having different numbers of optical fibers 10. These optical fiber rows may have an equal number of optical fibers 10 instead.

Figure 7:
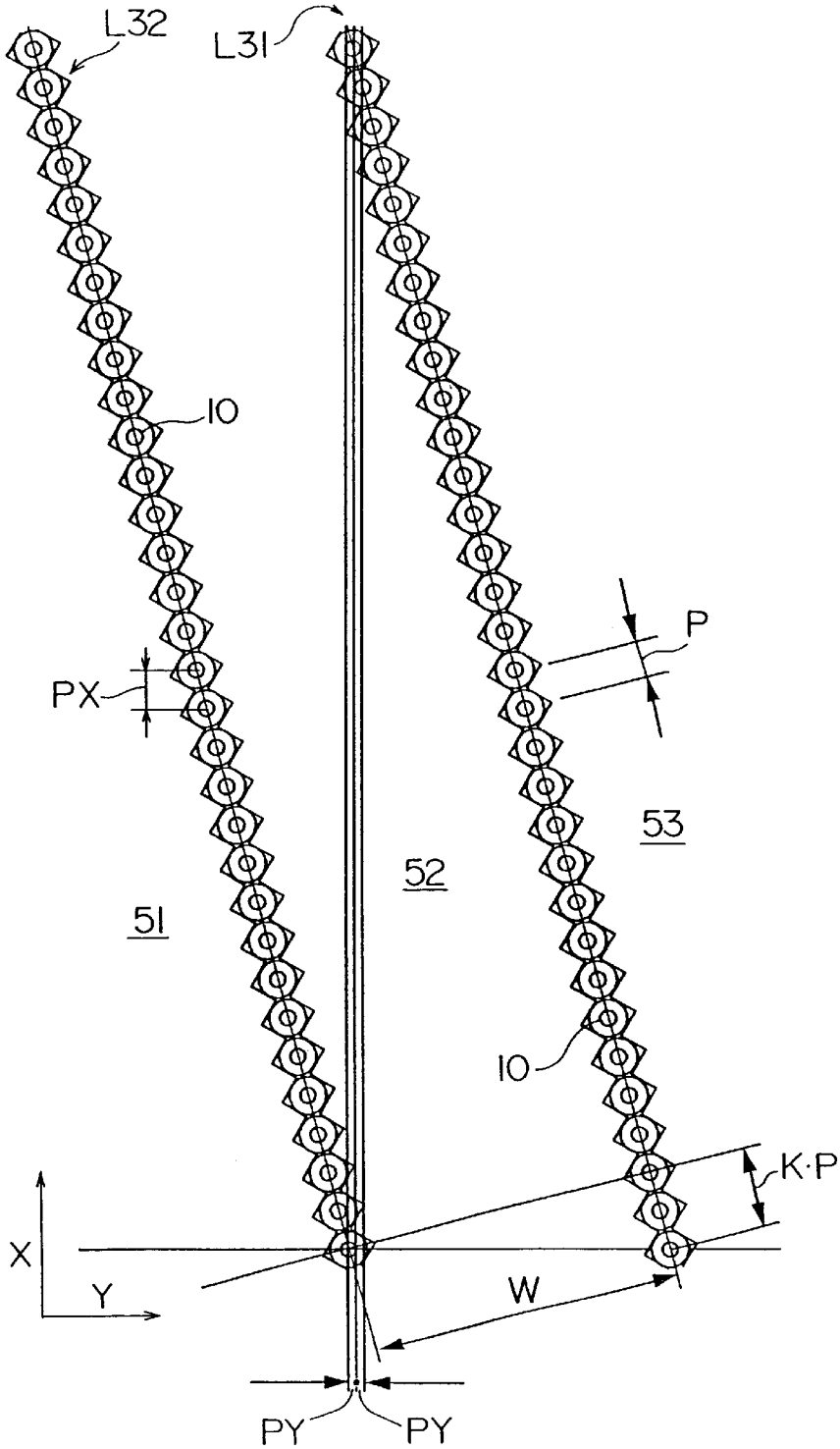
FIG. 7 is an explanatory view showing an arrangement of optical fibers in a third embodiment of the invention.

An arrangement of optical fibers 10 in a third embodiment will be described next. FIG. 7 is an explanatory view showing the arrangement of optical fibers 10 in the third embodiment of the invention.

The third embodiment shown in FIG. 7 uses a pair of optical fiber rows L31 and L32 having an equal number of optical fibers 10. That is, the third embodiment shown in FIG. 7 corresponds to the second embodiment shown in FIG. 6, with the number of optical fiber rows reduced to two, and these optical fiber rows L31 and L32 having an equal number of optical fibers. In the third embodiment, the optical fibers 10 at the forward end (lower end in FIG. 7) and the rear end (upper end in FIG. 7) of the optical fiber rows L31 and L32 are in the same position in the primary scanning direction.

The optical fibers 10 constituting these optical fiber rows L31 and L32 are positioned as pinched between a base plate 52 with numerous V-grooves formed in opposite sides thereof for positioning the optical fibers 10, and a pair of base plates 51 and 53 each with numerous V-grooves formed in one side thereof for positioning the optical fibers 10, which are similar to the base plates 31, 32 and 33 in the first embodiment.

In the image recording apparatus having the above construction also, there is no need to arrange the plurality of optical fiber rows as shifted by 1/N of the pitch P in the secondary scanning direction as required in the image recording apparatus described in Japanese Patent Publication (Unexamined) No. 2000-141749. Thus, the apparatus in this embodiment is easy to manufacture.

The image recording apparatus in this embodiment also may reduce the delay time TPX in the emission timing due to the pitch PX in the primary scanning direction of the optical fibers 10 constituting the optical fiber rows L31 and L32, excluding a portion extending from the optical fiber row L31 to the optical fiber row L32. This produces an effect of improving the apparent sensitivity of the recording material 18 in the form of a thermosensitive material.

Further, in the image recording apparatus in this embodiment, the positions of the projections in the secondary scanning direction of the optical fibers 10 constituting the optical fiber rows L31 and L32 all coincide with each other. Since the phases of image recording timing of the optical fibers 10 are in perfect agreement, the image recording timing, i.e. driving of the semiconductor lasers 12, may easily be controlled by the controller 11.

In the above embodiments, the optical fibers 10 are positioned and fixed by the base plates 31, 32, 33, 41, 42, 43, 44, 45, 51, 52 and 53 acting as support members defining numerous positioning V-grooves. The optical fibers 10 may be positioned and fixed by using different shape fixing grooves such as U-grooves.

In the above embodiments, the optical fibers 10 are fixed between two base plates defining V-grooves. Instead, the optical fibers 10 may be fixed between a plain plate and a plate defining V-grooves.

In the embodiment illustrated in FIGS. 3 and 4, the base plates 31, 32 and 33 are rotated to uniform the spacing between the projections in the primary scanning direction of the optical fiber rows. The embodiment illustrated in FIGS. 6 and 7 have been described as designed to have a uniform spacing between the projections in the primary scanning direction between the optical fiber rows from the beginning. However, the base plates may be rotated for fine adjustment in order to meet tolerances. This aspect also is included in the scope the present invention of course.

The present invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2001-177990 filed in the Japanese Patent Office on Jun. 13, 2001, the entire disclosure of which is incorporated herein by reference.

What is claimed is:

1. An image recording apparatus for recording an image on a recording material by irradiating the recording material with light beams emitted from a plurality of optical fibers, and causing the light beams to make a primary scan and a secondary scan of the recording material, said apparatus comprising:

a plurality of optical fiber rows each having a plurality of optical fibers supported by a base plate having a plurality of grooves arranged at a fixed pitch P and arranged at said fixed pitch P;

said plurality of optical fiber rows being arranged parallel to each other in a direction intersecting a primary scanning direction and a secondary scanning direction;

optical fibers disposed at adjacent ends of said plurality of optical fiber rows being shifted from each other by a multiple of said fixed pitch P in a direction of arrangement of said optical fibers; and said optical fibers constituting said plurality of optical fiber rows having projections thereof arranged at a fixed pitch PY in said primary scanning direction.

2. An image recording apparatus as defined in claim 1, wherein said plurality of optical fiber rows are in form of a pair of optical fiber rows arranged at an adjustable angle to said secondary scanning direction.

3. An image recording apparatus as defined in claim 2, wherein said optical fibers constituting said plurality of optical fiber rows have projections thereof in said secondary scanning direction arranged at a pitch PX of projections in said secondary scanning direction of said optical fibers constituting each of said optical fiber rows.

4. An image recording apparatus as defined in claim 3, wherein said plurality of optical fiber rows include an equal number of optical fibers, optical fibers disposed at ends of said plurality of optical fiber rows coinciding with each other in said primary scanning direction.

5. An image recording apparatus as defined in claim 1, wherein said recording material is a thermosensitive material responsive to heat generated by light beams for recording the image.

6. An image recording apparatus as defined in claim 4, comprising an imaging optical system for imaging light beams emitted from said optical fibers on said recording material.

7. An image recording apparatus as defined in claim 6, comprising an assembly for varying the magnification of said imaging optical system.

8. An image recording apparatus as defined in claim 7, said grooves are shaped as V-grooves.

9. An image recording apparatus as defined in claim 7, said grooves are shaped as U-grooves.

10. An image recording apparatus as defined in claim 7, comprising a recording drum on which said recording material are wrapped, and an assembly for rotating said recording drum in the primary scanning direction of the light beams.

11. An image recording apparatus for recording an image on a recording material by irradiating the recording material with light beams emitted from a plurality of optical fibers, and causing the light beams to make a primary scan and a secondary scan of the recording material, said apparatus comprising:

a pair of optical fiber rows each having a plurality of optical fibers supported by a base plate having a plurality of grooves arranged at a fixed pitch P and arranged at said fixed pitch P;

said pair of optical fiber rows being arranged parallel to each other in a direction intersecting a primary scanning direction and a secondary scanning direction;

said pair of optical fiber rows including an equal number of optical fibers;

said pair of optical fiber rows being arranged at an adjustable angle to said secondary scanning direction;

optical fibers disposed at adjacent ends of said pair of optical fiber rows being shifted from each other by a multiple of said fixed pitch P in a direction of arrangement of said optical fibers; and said optical fibers constituting said pair of optical fiber rows having projections thereof arranged at a fixed pitch PY in said primary scanning direction.

12. An image recording apparatus as defined in claim 11, wherein said optical fibers constituting said pair of optical fiber rows have projections thereof in said secondary scanning direction arranged at a pitch PX of projections in said secondary scanning direction of said optical fibers constituting each of said optical fiber rows.

13. An image recording apparatus as defined in claim 12, wherein said recording material is a thermosensitive material responsive to heat generated by light beams for recording the image.

14. An image recording apparatus for recording an image on a recording material by irradiating the recording material with light beams emitted from a plurality of optical fibers, and causing the light beams to make a primary scan and a secondary scan of the recording material, said apparatus comprising:

a pair of optical fiber rows each having a plurality of optical fibers supported by a base plate having a plurality of grooves arranged at a fixed pitch P and arranged at said fixed pitch P;

said pair of optical fiber rows being arranged parallel to each other in a direction intersecting a primary scanning direction and a secondary scanning direction;

said pair of optical fiber rows including an equal number of optical fibers;

said pair of optical fiber rows being arranged at an adjustable angle to said secondary scanning direction;

optical fibers disposed at ends of said pair of optical fiber rows coinciding with each other in said primary scanning direction; and said pair of optical fibers constituting said optical fiber rows having projections thereof arranged at a fixed pitch PY in said primary scanning direction.

15. An image recording apparatus as defined in claim 14, wherein said optical fibers constituting said pair of optical fiber rows have projections thereof in said secondary scanning direction arranged at a pitch PX of projections in said secondary scanning direction of said optical fibers constituting each of said optical fiber rows.

16. An image recording apparatus as defined in claim 15, wherein said recording material is a thermosensitive material responsive to heat generated by light beams for recording the image.

* * * * *